US005672048A

United States Patent [19]

Yu

[11] Patent Number: 5,672,048

[45] Date of Patent: Sep. 30, 1997

[54] CEILING FAN HOUSING

[76] Inventor: Jack Yu, No. 109-1, Avenue 6, Lane 164, Tzong Sa Road, Da Du Hsiang, Taichung Hsien, Taiwan

[21] Appl. No.: 701,679

[22] Filed: Aug. 22, 1996

[51] Int. Cl.[6] ..... F04D 29/32; F04D 29/64

[52] U.S. Cl. ..... 416/5; 416/244 R; 362/96; 362/122; 362/240; 362/294

[58] Field of Search ..... 416/5, 93 R, 170 R, 416/249 R; D23/377, 379, 385, 411; 417/360, 423.14; 415/214.1; 362/96, 122, 240, 149, 294, 373; 403/335, 336, 338; 411/84; 310/89

[56] References Cited

U.S. PATENT DOCUMENTS 4,363,083 12/1982 Tanaka et al. ..... 362/294
4,402,649 9/1983 Laurel ..... 416/5
4,626,970 12/1986 Huang ..... 416/5
4,863,346 9/1989 Lin ..... 416/5
5,439,350 8/1995 Yu ..... 416/5
5,441,387 8/1995 Yu ..... 416/5
5,580,156 12/1996 Suzuki ..... 362/373

*Primary Examiner*—Christopher Verdier
*Attorney, Agent, or Firm*—Charles E. Baxley, Esq,

[57] ABSTRACT

A housing for a ceiling fan includes a transparent cylindrical member. A bottom plate and a cover are engaged with the cylindrical member. One or more panels are received in the cylindrical member and disposed between the bottom plate and the cover. A number of fastening members are engaged through the cover and the panels and the bottom plate for securing the bottom plate and the cylindrical member and the cover together and for securing the panels in place. One or more light bulbs are disposed in the cylindrical member for lighting the panels.

1 Claim, 2 Drawing Sheets

CEILING FAN HOUSING

BACKGROUND OF THE INVENTION

1. Field of the Invention

The present invention relates to a housing, and more particularly to a ceiling fan housing.

2. Description of the Prior Art

The closest prior arts of which applicant are aware are U.S. Pat. Nos: 5,439,350, 5,441,387 and 5,503,524, all issued to Yu who is also the applicant of the present invention. The prior arts disclose a ceiling fan housing that includes a number of patterns or panels secured to the cylindrical member. However, the patterns may not be easily and solidly attached and secured to the cylindrical member which is made of glass material. In addition, the panels are exposed such that gaps are formed between the panels and the cylindrical member and such that the ceiling fan housing may not be easily cleaned.

The present invention has arisen to mitigate and/or obviate the afore-described disadvantages of the conventional ceiling fan housings.

SUMMARY OF THE INVENTION

The primary objective of the present invention is to provide a ceiling fan housing which includes a number of panels secured in a cylindrical member of glass or transparent material for allowing the patterns of the panels to be seen through the transparent cylindrical member.

In accordance with one aspect of the invention, there is provided a housing for a ceiling fan comprising a cylindrical member made of transparent material, the cylindrical member including an upper portion and a lower portion, a bottom plate engaged with the lower portion of the cylindrical member, a cover engaged on the upper portion of the cylindrical member, at least one panel received in the cylindrical member and disposed between the bottom plate and the cover, and a plurality of fastening members engaged through the cover and the panel and the bottom plate for securing the bottom plate and the cylindrical member and the cover together, and for securing the panel in place.

A board is further engaged between the cylindrical member and the cover, and at least one light bulb is secured to the board for lighting the panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
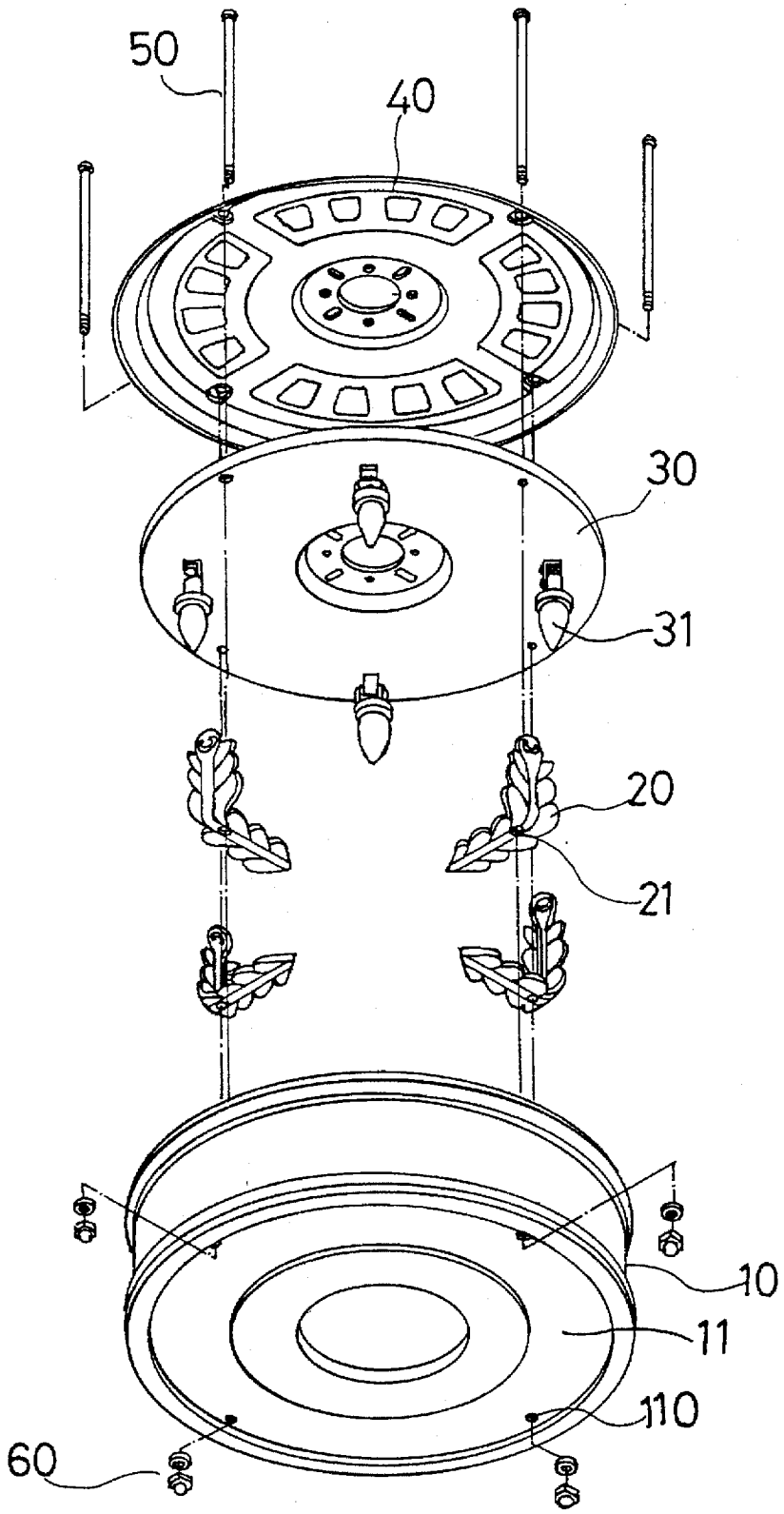
FIG. 1 is an exploded view of a ceiling fan housing in accordance with the present invention.
Figure 2:
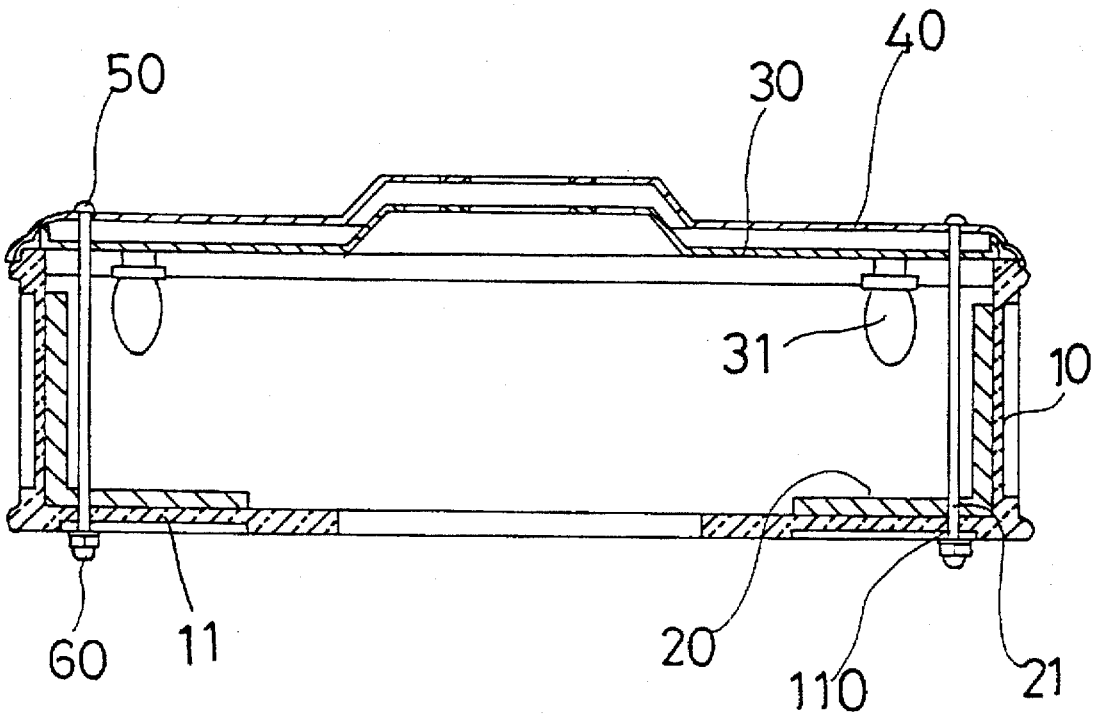
FIG. 2 is a cross sectional view of the ceiling fan housing.

Referring to the drawings, a ceiling fan housing in accordance with the present invention comprises a cylindrical member 10 including a bottom plate 11 in the form of a peripheral flange extended radially inward from the bottom portion of the cylindrical member 10. The bottom plate 11 includes a number of holes 110 formed therein for engaging with bolts 50 which may engage with nuts 60. A board 30 and a cover 40 are engaged on the cylindrical member 10. The board 30 is provided for securing a number of light bulbs 31 thereto. A number of panels 20 of suitable patterns are engaged in the cylindrical member 10 and each includes an orifice 21 formed therein for engaging with the bolts 50. The bolts 50 are engaged through the cover 40 and the board 30 and the peripheral flange 11 of the cylindrical member 10 and are engaged with the nuts 60 so as to secure the cover 40 and the board 30 and the cylindrical member 10 together. The bolts 50 also engage through the panels 20 for securing the panels 20 in place.

It is to be noted that the cylindrical member 10 is made of transparent material, such as glass, for allowing the panels 20 to be seen through the transparent cylindrical member 10. Beautiful lights and shapes may be formed when the light bulbs 31 are energized. It is further to be noted that the bottom wall or the peripheral flange 11 is not necessary to be formed integral with the cylindrical member 10 and may be separated from the cylindrical member 10. The panels 20 are not necessary to be secured to the cylindrical member 10 such that the cylindrical member 10 will not be easily broken when the cylindrical member 10 is made of glass material. The panels 20 may be secured together so as to form an integral panel.

Accordingly, the ceiling fan housing in accordance with the present invention includes a number of panels secured within the cylindrical member without attaching to the cylindrical member such that the cylindrical member can be prevented from being broken.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing for a ceiling fan comprising:

a cylindrical member made of transparent material, said cylindrical member including an upper portion and including a bottom plate, a cover engaged on said upper portion of said cylindrical member, at least one panel received in said cylindrical member and disposed between said bottom plate and said cover, and engaged with said bottom plate and said cylindrical member, a plurality of fastening members engaged through said cover and said at least one panel and said bottom plate for securing said bottom plate and said cylindrical member and said cover together, and for securing said at least one panel in place, a board engaged between said cylindrical member and said cover, and at least one light bulb secured to said board for lighting said at least one panel and for allowing said panel to be seen through said cylindrical member.

* * * * *